US006122877A

United States Patent [19]

Hendrickson et al.

[11] Patent Number: 6,122,877

[45] Date of Patent: Sep. 26, 2000

[54] FIBER-POLYMERIC COMPOSITE SIDING UNIT AND METHOD OF MANUFACTURE

[75] Inventors: Gerald L. Hendrickson, Maple Grove; Kurt E. Heikkila, Circle Pines; Timothy P. Murphy, Chisago City; Maurice N. Goeser, Maplewood, all of Minn.

[73] Assignee: Andersen Corporation, Bayport, Minn.

[21] Appl. No.: 08/866,289

[22] Filed: May 30, 1997

[51] Int. Cl.[7] ..... F04B 1/12; F04B 2/08; F04B 2/18

[52] U.S. Cl. ..... 52/520; 52/233; 52/309.1; 52/404.1; 52/539; 52/585.1; 52/592.1; 52/745.19

[58] Field of Search ..... 52/233, 309.11, 52/404.1, 520, 539, 585.1, 745.19, 309.1, 592.1

[56] References Cited

U.S. PATENT DOCUMENTS

| | | |
|---|---|---|
| Re. 32,772 | 10/1988 | Hawley . |
| 2,763,573 | 9/1956 | Biefeld . |
| 2,830,925 | 4/1958 | Fennebresque et al. . |
| 3,593,479 | 7/1971 | Hinds et al. . |
| 3,651,195 | 3/1972 | Ole-Bendt Rasmussen . |
| 3,707,399 | 12/1972 | Uffner . |
| 3,740,915 | 6/1973 | Mollman . |
| 3,866,378 | 2/1975 | Kessler . |
| 4,004,387 | 1/1977 | Ellingson . |
| 4,090,339 | 5/1978 | Anderson . |
| 4,100,325 | 7/1978 | Summers et al. . |
| 4,110,062 | 8/1978 | Summers . |
| 4,110,510 | 8/1978 | Oliveira . |
| 4,122,643 | 10/1978 | Hafner . |
| 4,183,777 | 1/1980 | Summers et al. . |
| 4,327,528 | 5/1982 | Fritz . |
| 4,346,541 | 8/1982 | Schmitt . |
| 4,366,197 | 12/1982 | Hanlon et al. . |
| 4,422,266 | 12/1983 | Slocum et al. . |
| 4,437,274 | 3/1984 | Slocum et al. . |
| 4,439,387 | 3/1984 | Hawley . |
| 4,464,432 | 8/1984 | Dost et al. . |
| 4,464,872 | 8/1984 | Eaton . |
| 4,468,903 | 9/1984 | Eaton et al. . |
| 4,468,909 | 9/1984 | Eaton . |
| 4,492,063 | 1/1985 | Schock et al. . |
| 4,580,383 | 4/1986 | Pittman et al. . |
| 4,592,185 | 6/1986 | Lynch et al. . |
| 4,617,774 | 10/1986 | Pittman et al. . |
| 4,680,234 | 7/1987 | Kelch . |
| 4,746,565 | 5/1988 | Bafford et al. . |
| 4,755,414 | 7/1988 | Lacatus et al. . |
| 4,770,834 | 9/1988 | Nakasone et al. . |
| 4,822,833 | 4/1989 | Zappia et al. . |
| 4,885,205 | 12/1989 | Wahl et al. . |
| 5,008,145 | 4/1991 | Kinson et al. . |
| 5,045,377 | 9/1991 | Amata . |
| 5,074,093 | 12/1991 | Meadows ..... 52/520 X |
| 5,096,645 | 3/1992 | Fink . |
| 5,136,822 | 8/1992 | Blum . |
| 5,176,775 | 1/1993 | Montsinger . |
| 5,207,850 | 5/1993 | Parekh . |
| 5,212,914 | 5/1993 | Martin et al. . |
| 5,222,343 | 6/1993 | Anderson . |
| 5,224,318 | 7/1993 | Kemerer . |
| 5,268,050 | 12/1993 | Azari . |
| 5,277,013 | 1/1994 | Gilbert . |
| 5,294,461 | 3/1994 | Ishida . |
| 5,310,600 | 5/1994 | Tsuya et al. . |
| 5,324,377 | 6/1994 | Davies . |
| 5,356,705 | 10/1994 | Kelch et al. . |
| 5,374,385 | 12/1994 | Binse et al. . |
| 5,406,768 | 4/1995 | Giuseppe et al. . |
| 5,423,153 | 6/1995 | Woolems et al. . |
| 5,431,996 | 7/1995 | Giesemann . |
| 5,441,801 | 8/1995 | Deaner et al. . |
| 5,451,355 | 9/1995 | Boissonnat et al. . |
| 5,455,090 | 10/1995 | Da RéMario et al. . |
| 5,486,553 | 1/1996 | Deaner et al. . |
| 5,497,594 | 3/1996 | Giuseppe et al. . |
| 5,518,677 | 5/1996 | Deaner et al. . |
| 5,539,027 | 7/1996 | Deaner et al. . |
| 5,543,234 | 8/1996 | Lynch et al. . |
| 5,586,422 | 12/1996 | Hoffner ..... 52/233 X |

FOREIGN PATENT DOCUMENTS 2 082 112 3/1982 United Kingdom .

OTHER PUBLICATIONS

Dialog Search of Feb. 11, 1997, "Search for patent owned by B.F. Goodrich Company for a product called DURACAP." (three pages).

Louisiana–Pacific "Lap Siding" flyer, Publication No. 11–6–I/S 10M Jan. 1997.
"Simpson Guardian Siding: Durability and Weatherability in an Attractive, Easy to Finish Overlaid Plywood Siding" flyer, copyright 1987 Simpson Timber Company.
"Chemcrest Cedar Motifs™ Siding" brochure, Chemcrest Architectural Products, Winnipeg, Manitoba, Canada.
Chateau "Vinyl Siding/Soffit Planning Guide" brochure, Chateau Vinyl Products, Kearney, Missouri, Form SA83745–287.
"Imagine a Dream Home That Comes With a Down–to–Earth Reward" brochure, Reward Wall Systems, Inc.™, 3•10 Insulated Forms, L.P., National Distributor of Stay–in–Place Concrete Forms, Papillion, Nebraska, Copyright 1995.

*Primary Examiner*—Christopher T. Kent
*Attorney, Agent, or Firm*—Merchant & Gould P.C.

[57] ABSTRACT

A siding assembly and method of manufacture are disclosed. Each siding unit is a profile of a composite material which includes a thermoplastic polymer and a cellulosic fiber. The preferred siding unit has a tapered thickness and a convex face. Each siding unit is interconnected to adjacent siding units with a tongue and groove mechanism. The preferred siding profile has a plurality of webs, and the exposed portion of the siding has a capstock layer to improve weatherability. The exposed width of the siding's face may be adjustable. The siding units are interconnected end-to-end by inserts which are positioned by means of an adhesive or thermal welding.

57 Claims, 9 Drawing Sheets

FIBER-POLYMERIC COMPOSITE SIDING UNIT AND METHOD OF MANUFACTURE

The invention relates to an extruded or molded cooperating unit made of a composite material of a fiber and a polymeric material used as exterior siding or trim. One unit or a plurality of the units are adapted to be laid in overlapping courses to provide a weather-protective, ornamental exterior siding for houses and various other commercial and residential buildings.

BACKGROUND OF THE INVENTION

Conventional materials have been used traditionally for exterior protective surfaces on residential and industrial structures. Brick has been a leading siding material for many years. Stucco has found significant use in new construction in the southern and western regions of the United States. Wood siding has also been a popular choice for many years. Traditional wood siding in a clapboard or shake is characterized by a tapered shape from a rather thick base portion to a rather thin upper edge. This design permits the siding to be nailed to the studs or other framing components of the house in overlapping relationship, in which the lower edge of each course overlaps the upper edge of the next lower course so as to shed rain.

Currently, aluminum, hardboard, Masonite™, plywood and vinyl have dominated the siding market because of their lower cost and maintenance as compared with brick, stucco or wood. These materials have been fabricated to simulate the shape and texture of the classic clapboards, wood shakes and shingles that consumers prefer. The shapes and textures of the classic exterior surface materials produce attractive patterns of highlights and shadow lines on walls as the sun shifts in position during daylight.

Wood siding, while being attractive, requires periodic painting, staining or finishing. Wood siding may also be susceptible to insect attack if not finished properly. This type of siding may also experience uneven weathering for unfinished surfaces, and has a tendency to split, cup, check or warp. Wood shingle siding has the additional problem of being relatively slow to install. In addition, clear wood products are slowly becoming more scarce and are becoming more expensive.

In an effort to avoid these problems, aluminum siding was developed, and has enjoyed a widespread acceptance nationwide. Aluminum siding is normally made by a roll forming process and is factory painted or enameled so as to require substantially no maintenance during the life of the installation. However, metal siding tends to be energy inefficient and may transfer substantial quantities of heat.

More recently, rigid plastic material has been used as a substitute for aluminum siding, with the most typical siding material being made of a vinyl polymer, e.g., polyvinyl chloride (PVC). Such plastic siding can be extruded in a continuous fashion or molded, after which lengths are cut to the desired length. Siding of this nature can be pigmented so as to be extruded or molded in the requisite color, thus avoiding the need for painting. However, it is difficult for the home owner to refinish this type of siding in a different color.

While aluminum and plastic sidings have obvious advantages, such as a preformed surface finish and the elimination of maintenance, these siding choices pose certain inherent disadvantages. First, aluminum and plastic siding can be damaged when struck by a hard object such as stones, hail, or even a ladder which is carelessly handled. Repairing such dents in aluminum and plastic siding is difficult. Conventional vinyl siding has an unattractive or unnatural softness or "give" to the touch," because extruded vinyl areas having less than about 0.100 of an inch in thickness are unduly flexible compared with the rigid look and feel of wood, stone, brick or stucco.

In addition, most plastic and metal sidings are subject to "canning," i.e., surface distortions from temperature differences and unequal stress on different parts of the siding. These temperature differences cause unsightly bulges and depressions at the visible surface of the siding. Vinyl siding has a high coefficient of thermal expansion and contraction. In order to accommodate this and to achieve the desired protective coverage, an installer will often substantially overlap the vertical edges of vinyl siding. This causes noticeable, unattractive, outward bends in the ends of the overlapping end portions of the siding.

Moreover, conventional plastic siding often presents a poor imitation of wood textures and unattractive butt joints. Extruded vinyl siding often has a synthetic-appearing graining which is rolled into the extruded product after a partially congealed (solidified) "skin" has formed on the extruded product. Such a synthetic-appearing graining repeats itself at frequent intervals along the length of the vinyl siding. This frequent repetition is caused by a relatively short circumference around the hardened-steel roller die on which the makes the graining pattern. Consumers do not value such vinyl siding highly.

Polymer materials have been combined with fibers to make extruded materials. Most commonly, polyvinyl chloride, polystyrene, and polyethylene thermoplastics have been used in such products. However, such materials have not successfully been used in the form of a siding member or any other type of structural member. Prior extruded thermoplastic composite materials cannot provide thermal and structural properties similar to wood or other structural materials. The prior extruded composite materials fail to have sufficient modulus, compressive strength, and coefficient of thermal expansion, all of which is necessary for an acceptable siding assembly. The structural characteristics of prior composite materials have not permitted any structural member to have a hollow profile design. Typical commodity plastics have achieved a modulus no greater than about 500,000 psi. In addition, prior attempts have often used a non-cellulosic fiber such as a glass or carbon fiber, which are more expensive than the preferred cellulosic fiber of the present invention.

Polyvinyl chloride has been combined with wood to make improved extruded materials. Such materials have successfully been used in the form of a structural member that is a direct replacement for wood. These extruded materials have sufficient modulus, compressive strength, coefficient of thermal expansion to match wood to produce a direct replacement material. Typical composite materials have achieved a modulus greater than about 500,000 and greater than 800,000 psi, an acceptable COTE, tensile strength, compressive strength, etc. Deaner et al., U.S. Pat. Nos. 5,406,768 and 5,441,801, U.S. Ser. Nos. 08/224,396, 08/224,399, 08/326,472, 08/326,479, 08/326,480, 08/372,101 and 08/326,481 disclose a PVC/wood fiber composite that can be used as a high strength material in a structural member. This PVC/fiber composite has utility in many window and door applications, as well as many other applications.

In addition, prior composites have not been durable enough to withstand the effects of weathering, which is an essential characteristic for siding. Further, many prior art extruded composites must be milled after extrusion to a final useful shape.

Accordingly, a substantial need exists for the development of a siding formed from a suitable composite material which can be directly formed by extrusion into reproducible, stable shapes advantageous for use as siding members. The siding structure must have resistance to weathering, relatively high strength and stiffness, an acceptable coefficient of thermal expansion, low thermal transmission, resistance to insect attack and rot, and a hardness and rigidity that permits sawing, milling, and fastening retention comparable to wood. The material must be easily formable and able to maintain reproducible stable dimensions, while having the ability to be cut, milled, drilled and fastened at least as well as wooden members.

A further need has existed for many years with respect to the byproduct streams produced during the conventional manufacture of wooden windows and doors. These byproduct streams have substantial quantities of wood trim pieces, sawdust, wood milling byproducts, recycled thermoplastics including recycled polyvinyl chloride, and other byproduct streams including waste adhesive, rubber seals, etc. Commonly, these materials are burned for their heat value and electrical power generation or are shipped to a landfill for disposal. Such byproduct streams are contaminated with hot melt and solvent-based adhesives, thermoplastic materials such as polyvinyl chloride, paint preservatives and other organic materials. A substantial need exists to find a productive, environmentally compatible use for such byproduct streams to avoid disposal of material in an environmentally harmful way.

SUMMARY OF THE INVENTION

This invention pertains to a siding or trim unit which is manufactured from a composite material made from a combination of cellulosic fiber and thermoplastic polymer materials, for example, wood fiber and polyvinyl chloride. The present invention also resides in a siding assembly made up of a plurality of siding units. Each siding unit is a profile of a composite material, which includes a thermoplastic polymer and a cellulosic fiber. The material comprises about 35–60 parts of fiber and 45–70 parts of polymer per 100 parts of the composite material. The preferred siding unit has a tapered thickness and a convex face. Each siding unit is interconnected to adjacent siding units with tongue and groove means. The siding profile has a plurality of webs, and the exposed portion of the siding has a capstock layer to improve weatherability. The exposed width of the siding's face may be adjustable. The siding units are interconnected end-to-end by a plurality of inserts in combination with adhesive means or thermal welding means.

Another aspect of the invention is a method of manufacturing a siding member. The method comprises the steps of compounding a composite material including a fibrous material and a thermoplastic material; providing a die having the desired shape of the siding member; coextruding the composite material with a coating; and cutting the profile to the desired length.

One advantage of the present invention is that once installed, the composite siding units require no periodic painting or other regular maintenance. The siding units of the invention will resist cracking, chipping or peeling. The siding of the present invention can be manufactured in the desired color, and the material is weatherable enough to resist fading so as to maintain an aesthetically pleasing appearance. If desired, the siding of the present invention can be refinished with acrylic paint after the surface has been cleaned with a solvent. The material is also resistant to decay and insects, is resistant to water, and does not corrode.

The siding of the present invention is aesthetically pleasing. The geometry of the siding creates desirable horizontal shadow lines, which help to lower the house's profile so that it seems closer to the earth. In addition, the visible width (face board) of each siding course can be adjusted so as to achieve the aesthetic objectives of each particular structure and situation. The siding of the present invention is relatively quick and easy to install, and can be cut and installed with conventional woodworking tools and fasteners. The units of the invention are also relatively light in weight, which also facilitates its handling by the installer.

Another advantage of the present invention is that it is impact resistant. When struck by a hard object, such as a stone or a baseball, the siding is less likely to leave an unsightly dent as compared to conventional aluminum and vinyl siding.

Another advantageous feature of the present invention is that it is not subject to canning. Temperature differentials do not cause surface distortions on the siding's surface, because of the preferred material used and because of the geometry of the siding's components. The siding has a relatively low coefficient of thermal expansion.

Yet another advantage of the present invention is that it is manufactured in an environmentally friendly manner. The siding utilizes wood and polyvinyl chloride waste products, thus reducing the burden on landfills. This becomes particularly important as the available supply of inexpensive timber for wood siding becomes scarce.

The composite siding material is easy to machine, and the siding units can be joined together using fasteners, thermal welding, or vibration tack welding. Furthermore, scrap material from these secondary processes can be recycled into usable parts, eliminating landfill fees and liabilities.

While previously known vinyls have been used for siding and other extruded objects, a coextruded siding structure made of a wood-plastic composite material has been previously unknown. As used herein, the term "thermoplastic material" is intended to mean thermoplastic polymer resins and/or thermoplastic copolymer resins which may or may not contain ingredients and/or additives including, but not limited to, stabilizers, lubricants, colorants, reinforcing particles, reinforcing fabric layers, laminates, surfacing layers, anti-foamants, anti-oxidants, fillers, foaming agents and/or other ingredients and/or additives for enhancing performance of the siding claimed herein.

As used herein, the term "rearwardly" or "rearward" means inwardly or inward toward the interior of an arbitrarily selected wall structure. The term "forwardly" or "forward" means outwardly or outward from a building structure in an exterior direction. The advantages of the composite material in siding is shown in the following table.

Siding Material Matrix

| Thermal | Dent |
|---|---|

| Material | COTE in/in/F° × $10^{+5}$ | Conductivity W/mK | Decay | Corrosion | HDT | Water Absorption | Standards | References | Resistance Testing* |
|---|---|---|---|---|---|---|---|---|---|
| Composite | 11 | 0.17 | N/A | N/A | 200° F. | 0.90% | Yes | 1 | −0.0070 |
| Aluminum | 12.1 | 173 | N/A | Yes | N/A | N/A | Yes | 2 | ** |
| PVC | 36 | 0.11 | N/A | N/A | 170° F. | N/A | Yes | 3 | −0.0650 |
| Cedar | 3 to 5 | 0.09 | Yes | N/A | N/A | Yes | Yes | 4 | −0.0630 |
| Masonite | N/A | N/A | Yes | N/A | N/A | 12% | Yes | 5 | −0.0025 |
| Steel | 12 | 59.5 | N/A | Yes | N/A | N/A | Yes | 6 | −0.0315 |

* Values obtained from testing performed at Aspen Research Corporation
** Value for interval could not be measured due to surface deformation
1. Fibrex Design Manual and Aspen Research Corp. test reports
2. Metals Handbook Vol. 29th Edition.
3. Specifications for Reynolds Siding - values obtained from product literature
4. Forest Products and Wood Science, JG Haygreen and JL Boyer, 1982 The Iowa State University Press
5. Masonite product literature
6. Metals Handbook Vol. 19th Edition.

Explanation of N/A status:
Decay: The N/A status indicates the material is not subject to decay because there is no biological mechanism to indicate decay
Corrosion: The N/A status indicates no mechanism in the material to promote corrosion
HDT (heat distortion temperature): The metals do not distort until an extremely high temperature which is outside the range of what siding would experience; therefore, not applicable. The N/A values for Masonite indicate that the value was not available.
Water Absorption: The metals do not uptake water; hence, the N/A status. The PVC value is low enough to be considered to be negligible.
ASTM Test Methods
COTE D696 - for Composite and PVC
Thermal Conductivity F433 - for Composite and PVC
HDT (heat distortion temperature) D648 for Composite and PVC
Moisture Absorption D570-84 for Composite and PVC

BRIEF DESCRIPTION OF THE DRAWINGS

In the drawings, which form a part of the instant specification and are to be read therewith, a preferred embodiment of the invention is shown, and in the various views, like numerals are employed to indicate like parts.

DETAILED DESCRIPTION OF THE PREFERRED EMBODIMENTS

Figure 1:
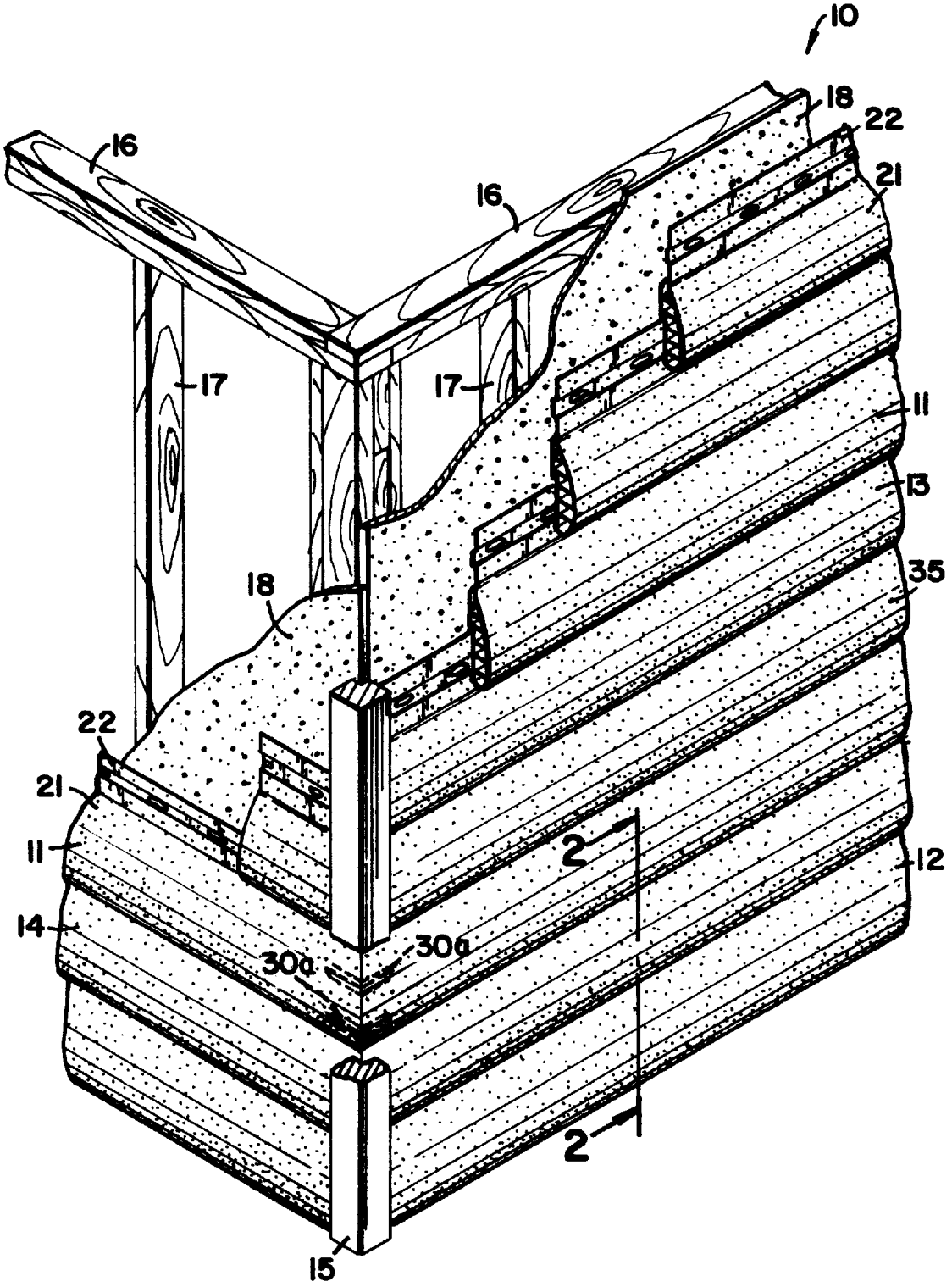
FIG. 1 is a perspective view of a corner portion of a building having the siding of the present invention installed thereon, partially cutaway for viewing clarity.

FIG. 1 depicts framing construction in a house or similar structure 10 in which the inventive siding system is installed on the exterior surface. Although the invention is applicable to buildings and structures of all types, it will be described for convenience and ease of description relative to a house, which is the preferred structure for application of the invention.

The house 10 is covered by a plurality of elongated, horizontal siding panels 11. Typically, the panels 11 are installed on all of the exterior wall surfaces 12 of the house. The house 10 has a side wall 13 and an end wall 14. A concave corner of the building between the walls 13, 14 has a concave vertical trim strip 15.

Ceiling or header joists 16 and wall studs 17 make up a portion of the house's frame structure. The header 16 and studs 17 may be made of wood (as shown) or may be made from aluminum channels or steel channels, or other structural, load-supporting members. The wall structure includes a sheathing layer 18, such as a layer of plywood, particleboard, or other suitable sheathing or structural layer. This sheathing layer 18 is secured to the studs 17 and header 16. Over the sheathing layer 18 is a water or air barrier sheet layer (not shown), for example, comprised of asphalt-impregnated building felt paper, or a non-woven housewrap material or the like. The lower part of each siding panel's main body portion 21 overlaps and covers the upper margin 22 of the next lower siding panel 11, and the panels are in hook engagement as will be described below.

When the siding system is installed on the building 10, a starter trim strip (not shown) is first fastened on the bottom periphery of each side of the house 10. The strip may be a conventional "J-channel" formed with its own nailing flange shown in detail below. After the starter strip is secured in place, a first course 12 of siding is installed horizontally along the width of a wall surface of the house 10. The lower edge of each elongated unit 12 is dropped into the U-channel in the starter strip, and the panel 12 is secured in place against the house 10 by a plurality of nails 20 driven through the slots in the nailing flange. Then, a second and successive courses of siding 11 are similarly installed in place. A vertical trim piece 15 covers the corner joint.

When the course of siding 11 reaches the top of a wall surface, a trim or accessory strip (not shown) is provided, which either caps off the siding system on that side of the house or provides a connection between the vertical wall surface and the other surfaces of the side, such as the soffit, overhang or fascia (not shown). Trim strips and other conventional siding accessories can be used to finish off the building surfaces on the edges, corners and around windows and doors. The trim strips and accessories may be one or two conventional J-channels.

Figure 2:
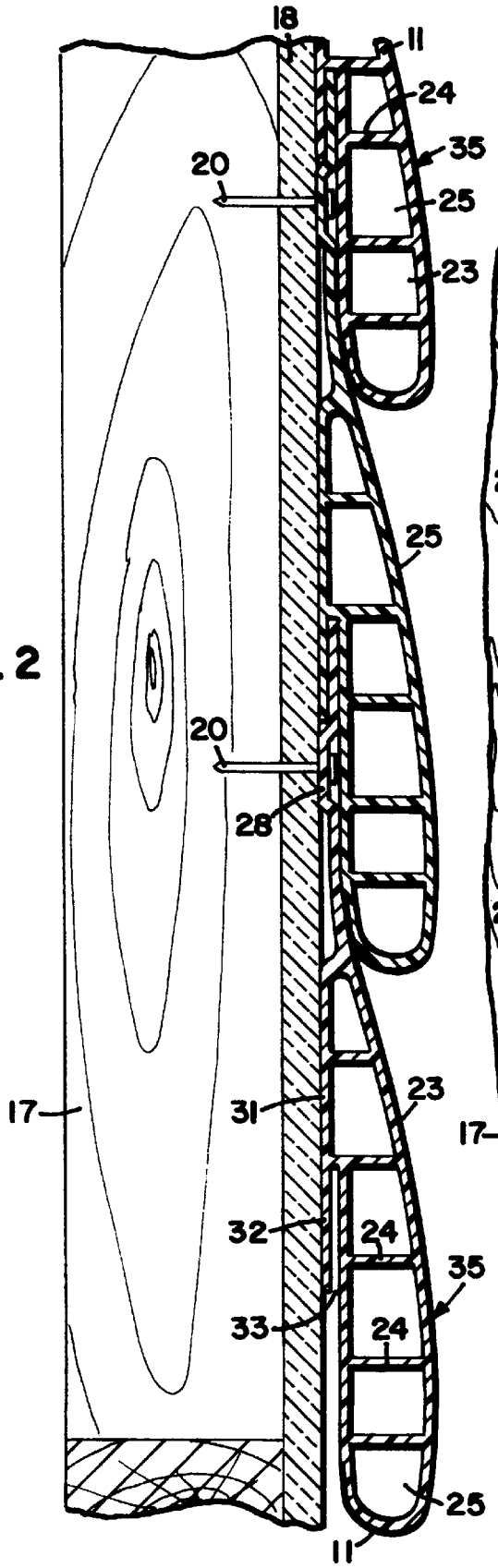
FIG. 2 is a cross-sectional, end elevation view of one of the exterior walls of the building of FIG. 1 as viewed along cross-section lines 2—2 of FIG. 1, illustrating the "narrow course" position or installation.
Figure 3:
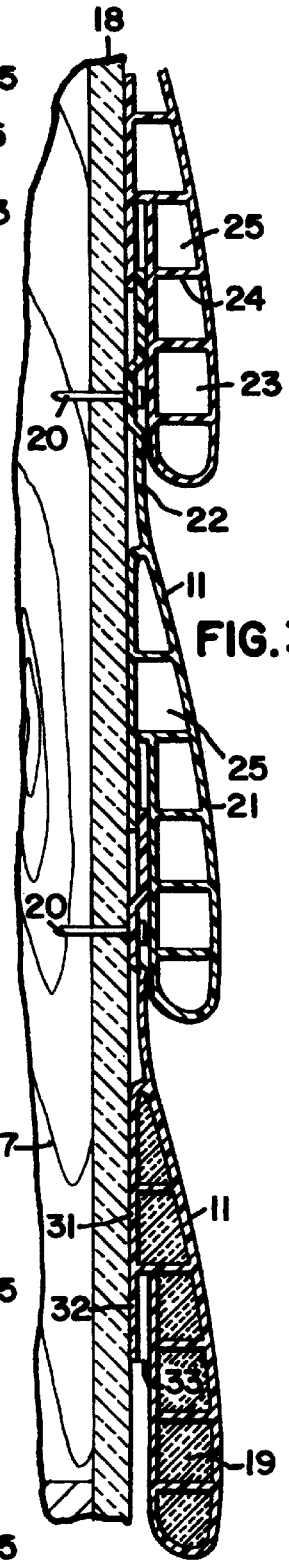
FIG. 3 is a cross-sectional, end elevation view of a plurality of siding units, illustrating the "wide course" position or installation.
Figure 4:
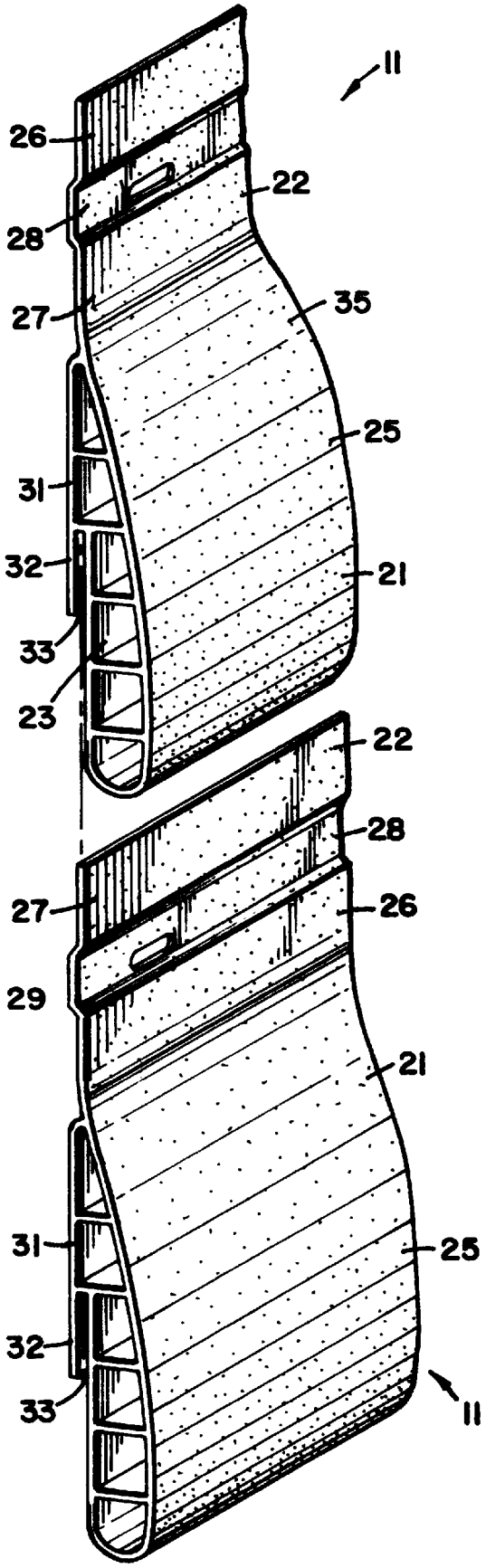
FIG. 4 is a perspective, exploded view of two siding units illustrated in FIGS. 1–3.

Preferred Geometry of the Siding Units As shown in FIGS. 2–4, the siding unit 11 comprises a main body portion 21 and an upper margin 22 which is integral with the main body portion. The main body portion 21 has a curved, concave front wall 25 which is exposed to the sun and weather elements when installed on the house 10. The front surface 25 of each siding unit 11 has a convex, outwardly bowed shape. The main body portion 21 of each siding unit 11 has a tapered thickness, with the lower end of the main body portion 21 having a greater thickness than the upper end of the main body portion 21. The curved portion and the depth of the siding provide deep shadow lines which are aesthetically pleasing to typical homeowners.

The siding unit 11 has one or more structural webs 23, which are made up of walls 24 and apertures 25. The webs 23 provide the siding unit with structural strength and rigidity in order to increase the siding's compressive strength, torsion strength, or other structural or mechanical properties. The apertures 25 in the siding provide air spaces within the siding structure. These air spaces 25 effectively provide a "dead air space" which minimizes the amount of air filtration.

Preferably, the siding profile 11 is formed from an extrusion process. Alternatively, it is possible for the siding member to be molded. The web members 23 are preferably formed integrally with the rest of the siding unit 11 during the extrusion or injection molding process. However, suitable web support members can be added from parts made during a separate manufacturing operation. The siding unit's web means may comprise a wall, post, support member, or other structural element. Although the apertures 25 preferably are empty, it is within the scope of this invention to fill the apertures 25 with an insulating foam 19, preferably low density PVC or other thermoplastic or low density polyurethane foam, which is commercially available.

In the preferred embodiment, the main portion 21 of each siding unit 11 has a web structure 23 made up of six apertures 25 and five interior walls 24. The walls 24 are substantially horizontal in the first embodiment of the siding unit. Each aperture 25 has a different cross-sectional shape and size, due to the convex shape of the siding unit 11. In the preferred embodiment, the total width of each siding unit is about 5–8 inches, preferably about 6¼ inches, and the width of the main body portion 21 is about 3–6 inches, preferably four inches. The preferred depth of the siding unit 11 at its widest point is approximately ½ to 2 inches, preferably about ¾ inch. The preferred thickness of each wall which forms the siding unit's profile is approximately 0.1 inch. The upper margin 22 of the siding unit 11 is approximately 2½ inches wide in the preferred embodiment.

The upper margin 22 has two substantially flat portions 26 and 27. A lower portion 27 is integral with the main body portion 21, and an upper mating flange 26. Portions 26 and 27 are separated by a central, rearwardly projecting attachment strip 28 having apertures for fasteners. The flat, back wall of the strip 28 abuts against the studs 18 of the house's framing structure. The lower portion 27 and mating flange 27 are preferably spaced away from the studs 18 when the siding is in its installed position.

The fastener strip 28 of the upper margin 22 has a series of apertures or slots 29 for passage of suitable fasteners such as nails 20, screws, etc. therethrough. The slots 29 are preferably elongated or oval in shape, rather than being circular, with the longer dimension of the slot 29 being parallel to the longitudinal direction of the siding unit 11. In the preferred embodiment, each slot is approximately ⅜ inch in length. The slots 29 are positioned higher than the longitudinal center line of the strip 28. The slots 29 may be premolded or machined into the rearward portion 28, and they may be countersunk, metal lined or otherwise adapted to the geometry or the composition of the fasteners. Preferably, the nail slots 29 are spaced at two inches on center. The nail slots 29 are suitable for ring shanked, galvanized number 6 nails. At least one slot 29 registers with each stud 18. The studs 18 are typically spaced at sixteen inches on center.

The inner surface of the siding unit 11 has a back wall 31 which is substantially flat. The back wall 31 conforms to the rough wall 18 and abuts against the studs 17 when the siding 11 is installed on the building 10. The back wall 31 is behind the main body portion 21, and the back wall 31 extends from the top of the main body portion 21 to a point approximately halfway along the main body portion 21. In the preferred embodiment, the back wall 31 is approximately 2¼ inches in width. The lower end of the back wall 31 is a flange 32 which is spaced away from the rear wall 34 of the main body portion 21. In the preferred embodiment, the flange 32 is approximately ½ inch in width. The flange 32 and back wall form a channel or groove means 33. The flange 32 and rear wall 34 of the main body portion 21 are formed such that the channel 33 is slightly wider at its upper end than at its lower end. In other words, the lower end of the flange 32 bends slightly in the forward direction.

For each course 11, the mating flange 26 nests in the channel 33 of the immediately adjacent, higher panel, as illustrated in the exploded view of FIG. 4. The upper margin 22 of each siding unit 11 is nailed to the house 10. The mating structure which allows rows of siding 11 to be inserted from above, nailed and interconnected in a tongue-and-groove structure, wherein the mating flange 26 is the tongue means.

The visible portion of the siding's front face 25 is adjustable in the preferred embodiment. This adjustment feature allows the architect or builder to choose the most desirable exterior appearance for each particular situation, because the visible width of the siding units 11 can be adjusted. The siding units 11 as illustrated in FIG. 2 are in the "narrow course" position. That is, the mating flange is in complete engagement with the channel 33, such that the upper surface of the mating flange 26 is in contact with the upper edge of the channel 33 on the upper siding unit 11. FIG. 3 illustrates the position of the siding units 11 in the "wide course" position. In this position, only the upper tip of the mating flange 26 is engaged with the lowermost part of the channel 33, which is defined by the lower edge of the flange 32. Because the width of the mating flange 26 and the width of the channel 33 are both approximately ½ inch, the range of adjustment for the visible width of the siding units 11 is approximately ½ inch. The siding can be positioned at a point intermediate between the positions illustrated in FIGS. 2 and 3, e.g., such that the mating flange 26 extends between 0 and ½ inch into the channel 33.

In order to ensure that the siding units 11 are installed in a straight, horizontal position, the installer can use conventional alignment methods when installing the siding units 11, such as the use of a jig, story tape or a story pole, snapping lines, or a spacer.

Figure 5:
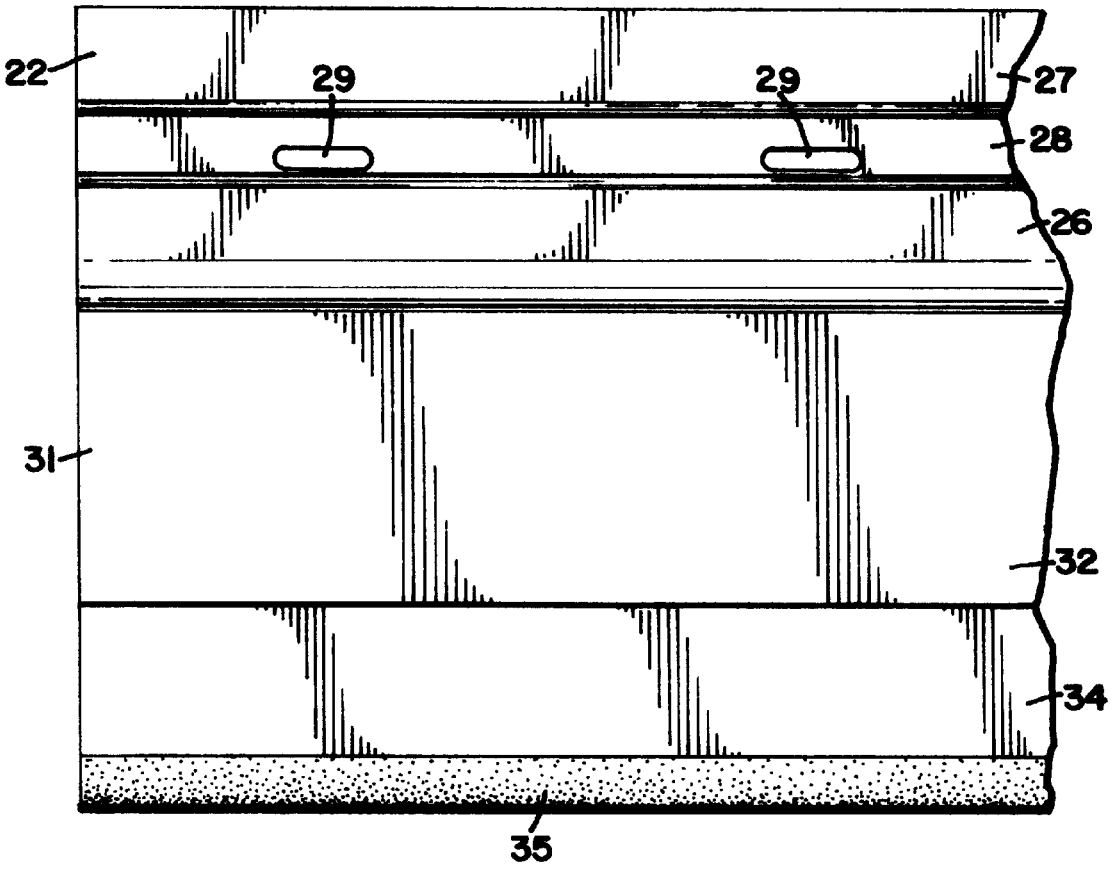
FIG. 5 is a rear elevational view of a rearward portion of a siding unit illustrated in FIGS. 1–4.

In the preferred embodiment, each siding unit has an exterior layer or capstock layer 35, which is decorative or protects the portions of the siding which are exposed to the sun and weather elements. The capstock 35 extends across the entire exposed front surface of the siding unit, as well as the bottom of the siding unit, and a lower part of the rear face of the siding unit 11, as illustrated in FIG. 5. The capstock layer 35 is illustrated with stippling in FIGS. 1, 4 and 5 and is illustrated with a thick line 35 in the lowest siding course in FIG. 2 for purposes of clarity. In the preferred embodiment, the capstock 35 has a smooth finish and is available in a variety of colors (in FIG. 5 the capstock 35 is shown as stipling). Alternatively, the capstock could have a decorative finish, such as a wood grain finish.

In an alternative view of the siding units shown in FIG. 4, FIG. 5 shows the rearwardly facing side of the unit. In FIG. 5, the mating flange 26 is shown extended from the flange 32 on the rearward surface of the convex portion of the siding. The upper margin 22 has two substantially flat portions 26 and 27 separated by a rearwardly projecting attachment or fastener strip 28. The fastening strip 28 contains apertures 29 for passage of fasteners such as nails or screws therethrough. Flange 31 and its extension 32 cooperate in joining the siding unit with other siding units in courses installed below the unit shown in FIG. 5. The lower end of the back wall 31 is a flange 32 which is spaced away from the rear wall 34 of the main body portion 21. The capstock material 35 is shown in the stippled portion of FIG. 5 which represents capstock which extends from the outwardly facing surface along the bottom edge of the unit into the rearwardly facing surface.

Figure 6:
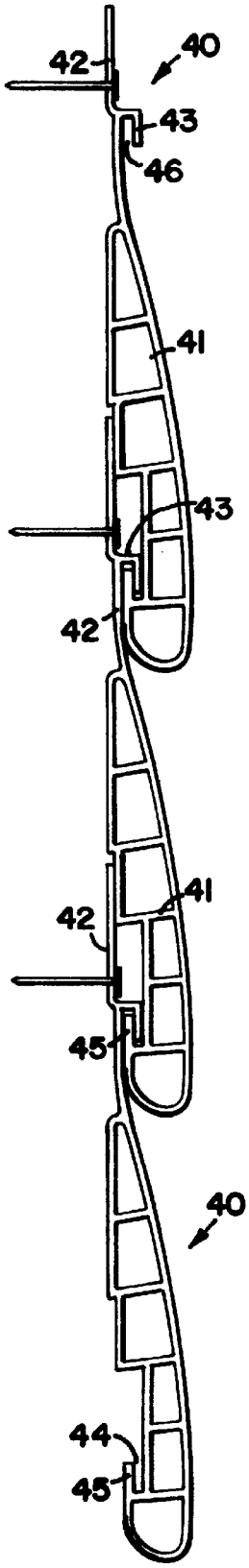
FIG. 6 is a side elevational view of an second embodiment of the siding unit.

An alternative siding profile, shown as 40, is illustrated in FIG. 6. This siding design has the same convex, aesthetically-pleasing appearance of the first embodiment. However, this siding unit 40 has a different interlock mechanism for connecting adjoining siding units. The siding 40 does not have the adjustability feature shown with the first embodiment. The siding unit 40 illustrated in FIG. 6 has a series of webs 41 and an upper flange 42. The upper flange 42 has a forwardly directed hook 43 having a notch 46. The unit is installed by nailing a fastening through flange 42. The rear, lower portion of the main body has a groove 44 which is sized an configured to accommodate the hook. The groove 44 is defined by the rear wall of one of the webs and an upwardly-extending tongue 45. The tongue 45 engages with the notch 46, and the hook 43 engages with the groove 44, in the manner shown in FIG. 6. In this manner, adjacent courses of siding 40 are interconnected. Preferably, the flange 42 has a series of slots (not shown) through which nails pass to engage with the support structure of the building. Because the flange 42 is positioned behind the next higher course of siding 40, the nails in flange 42 are hidden from view.

Figure 7A:
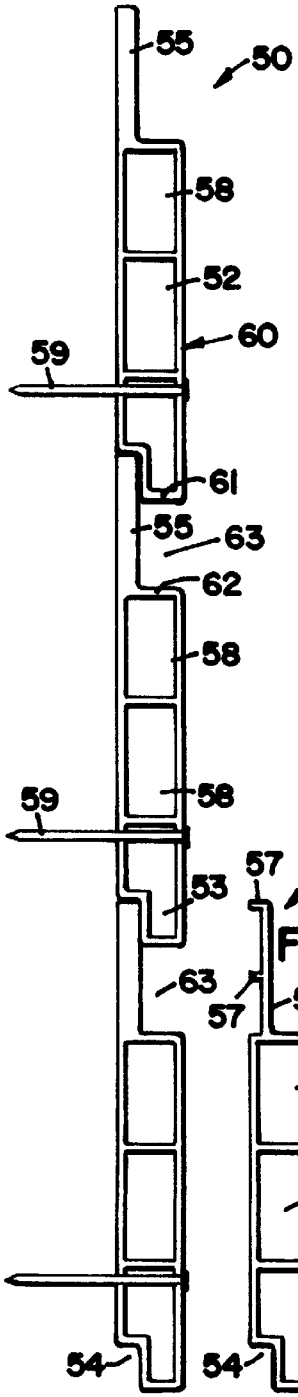
FIGS. 7A and 7B are side elevational views of a third and fourth embodiments of the siding unit.
Figure 7B:
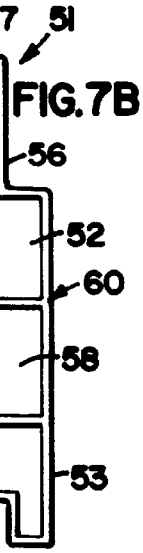

FIGS. 7A and 7B illustrate third and fourth embodiments 50, 51 of the siding of the present invention. Each siding unit 50, 51 has three portions: a central, main portion 52 having an exposed front face 60; an upper flange; and a lower portion 53 having a notch 54. The difference between the embodiments of FIGS. 7A and 7B is the construction of the upper flange. The upper flange 55 in FIG. 7A is made of solid construction, whereas the upper flange 56 in FIG. 7B has a thinner wall and reinforcing ribs 57. As is shown in FIGS. 7A and 7B, the main body portion 52 is hollow, which has a web structure with three apertures 58.

The type of siding 50, 51 illustrated in FIGS. 7A and 7B may be applied either horizontally or vertically. With this design, the nails 59 are not hidden from view. Rather, each nail 59 passes through the lower web aperture of the main body portion 52 of the siding 50, 51. Preferably, the notch 54 provides for an overlap of approximately one half inch between the adjacent siding units. The lower edge 61 of one course's front face 60 is spaced above the upper edge 62 of the next lower course, forming a groove 63 between adjacent courses of siding. Preferably, this groove 63 is approximately one inch wide.

Figure 8:
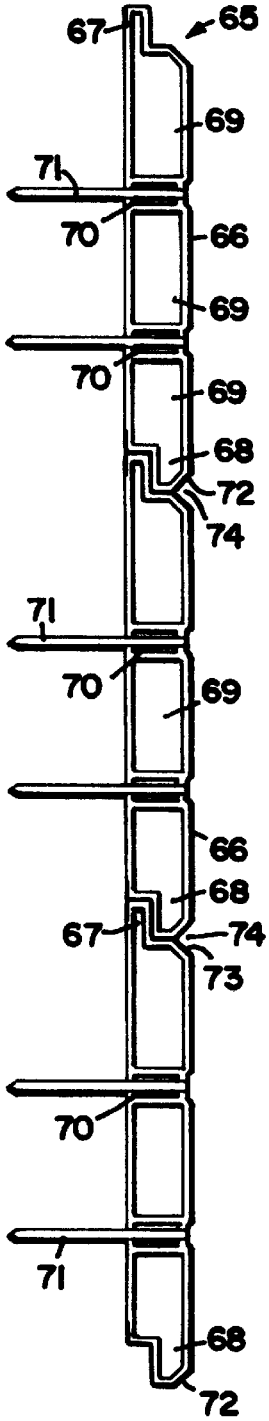
FIG. 8 is a side elevational view of a fifth embodiment of the siding unit.

FIG. 8 illustrates a fourth embodiment 65 of the siding of the present invention. This type of siding 65 may also be applied either horizontally or vertically. The siding 65 has three portions, a central body portion 66, an upper notch portion 67, and a lower notch portion 68. The central body portion 66 preferably has a web structure with a plurality (e.g.) a total of five apertures, with (e.g.) three of the apertures 69 being relatively large and two of the apertures 70 being relatively small. Each of the apertures 70 accommodates a nail 71. In the embodiment illustrated, two nails 71 are applied in each course of siding 65. The upper and lower notches 67, 68 are sized and configured such that the adjoining courses of siding 65 overlap. Preferably, each lower notch has a mitered portion 72, which abuts against a mitered portion 73 in the upper web of the main body portion. These mitered portions 72, 73 form a V-shaped groove 74.

The present invention has equal applicability to siding systems in which the panels are installed or positioned vertically. As described above, the embodiments of FIGS. 6–8 may be installed in a vertical manner. In addition, vertical siding units made of the inventive composite material may be of a shiplap or a tongue-and-groove type, or plain boards of the composite material may be applied in one of several ways, such as board and batten; board and board; and batten and board.

Figure 9:
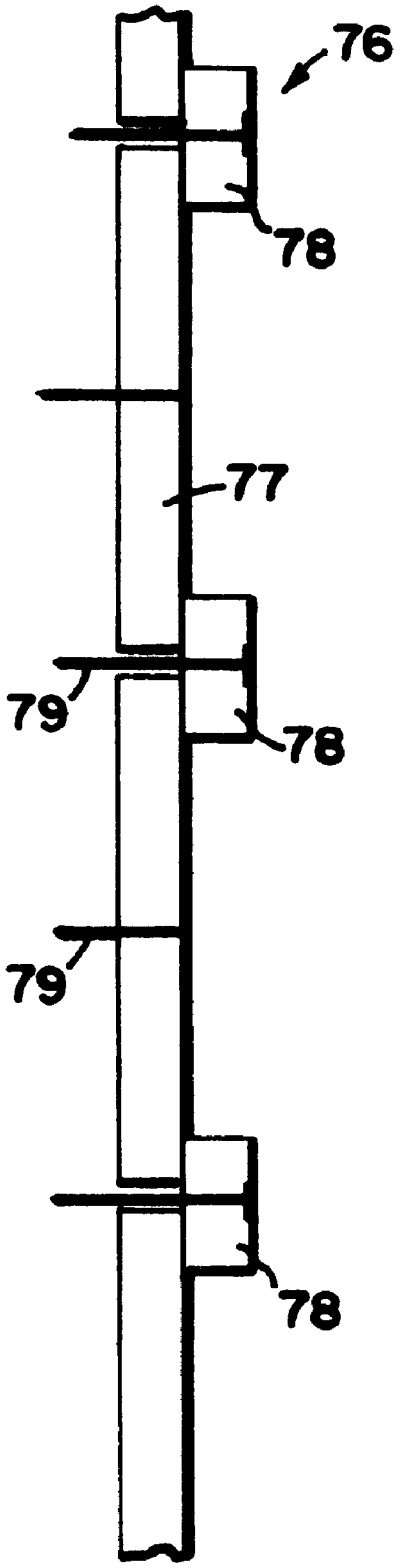
FIG. 9 is a top plan view of a sixth embodiment of the siding unit.

FIG. 9 illustrates a fifth embodiment of the present invention, in which a board and batten construction is employed. The siding 76 has a plurality of vertically extending boards 77, and a plurality of vertically extending battens 78. The composite material is used for both the board 77 and batten 78 components of the siding 76. Nails 79 pass through both the boards 77 and the battens 78. In the embodiment shown, both the board and batten are made of a solid length of composite material. However, the board and/or batten could be made of a hollow, webbed construction as illustrated with the other embodiments. In addition, the solid siding members could be made of a foamed composite material.

Figure 11:
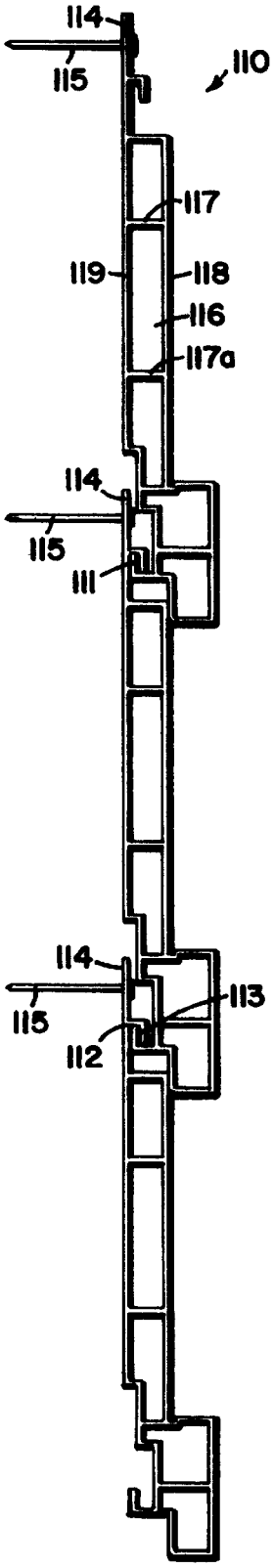
FIG. 11 is a top plan view of a seventh embodiment of the siding unit.
Figure 12:
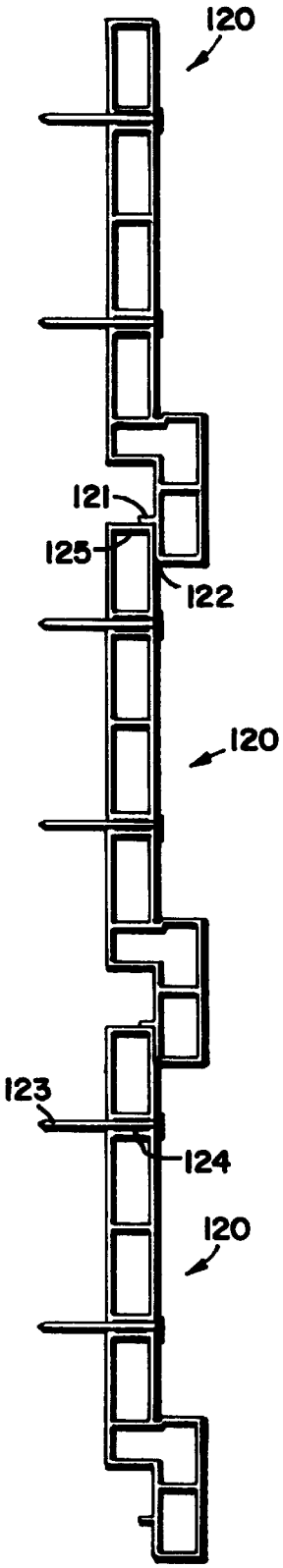
FIG. 12 is a top plan view of an eighth embodiment of the siding unit.
Figure 13:
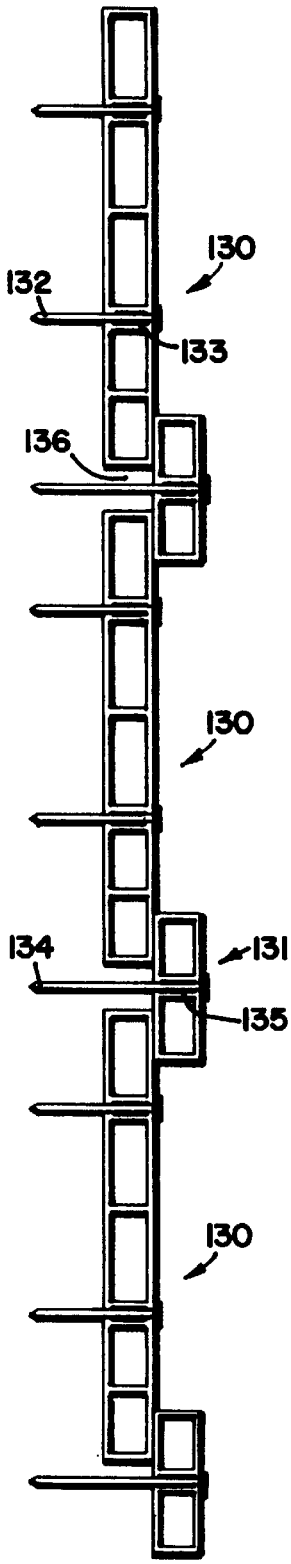
FIG. 13 is a top plan view of a ninth embodiment of the siding unit.

FIGS. 11–13 illustrate alternative siding profiles 110, 120, i.e., the seventh, eighth and ninth embodiments of the siding unit. These designs have a non-curved, more rectilinear but pleasing appearance. The profiles 110, 120 each have a unique interlock mechanism for connecting adjoining siding units. The embodiments of FIGS. 11–13 are suitable for vertical siding installations.

In FIG. 11 a tongue 111 engages notch 112 defined by hook portion 113. In this matter, adjacent courses of siding 110 are interconnected and held in place. Preferably, the flange 114 adjacent to hook 113 has a series of slots (not shown) through which nails 115 pass to engage with the support structure of the building (not shown). Because the flange 114 is positioned behind the adjacent course of siding 110, the nails in flange 114 are hidden from view. In the installation of siding 110, a first course is installed and attached to the building using nails 115. The next course is started by inserting tongue 112 into notch 111 defined by hook 113. That next course is fastened using nail 115 and the process is repeated for further vertical courses. In siding unit 110, the flange 114 is made of solid construction whereas the main body 118 of the unit 110 has a hollow structure. The main body portion 118 has hollow portions 116 which define a web structure. The siding unit has an outwardly facing portion 118 and an inwardly facing portion 119. The web's internal walls 117, 117*a* provide structure and stability to the unit.

FIG. 12 shows an overlapping installation of the siding unit 120 over adjacent siding units 120. An overlapping joint 122 is formed between adjacent siding units 120. In the installation of the siding unit 120, a first siding unit 120 is applied to a building surface and nailed into place using nails 123 that are directed through apertures 124. The second course of siding unit 120 is then applied overlapping the first course. A stop 121 butts against the upper portion 125 of the next lower unit to provide the appropriate amount of overlap between the adjacent siding units. Unit 120 has a hollow profile structure similar to that of the units shown in FIGS. 1 through 11.

FIG. 13 shows an alternative installation board and batten scheme. The embodiment illustrated in FIG. 13 is similar to the embodiment shown in FIG. 9, except that the FIG. 13 design has a webbed structure, rather than a solid structure. In FIG. 13, boards 130 are attached to a building surface using nails 132 directed through apertures 133. Following the installation of a first board, other boards can be installed leaving a gap 133 between courses of boards. The gaps 133 between the boards 130 are covered using battens 131. Battens 131 are attached to the siding system using nails 134 directed through apertures 135 in the battens. In one installation scheme, all the boards 130 are applied to the building surface prior to the installation of any batten 131. In another installation scheme, two courses of boards 130 can be applied to the building surface followed by one course of battens 131. A further board 130 course is applied followed by the appropriate batten 131 installation. The siding units shown in FIG. 13 are substantially rectilinear profiles that are made using the extrusion web technique common to the extruded profile shown in FIGS. 1 through 12. With any of these webbed embodiments, the hollow portions may contain "dead air," or the hollow portions may be filled with a suitable foam material.

Figure 14:
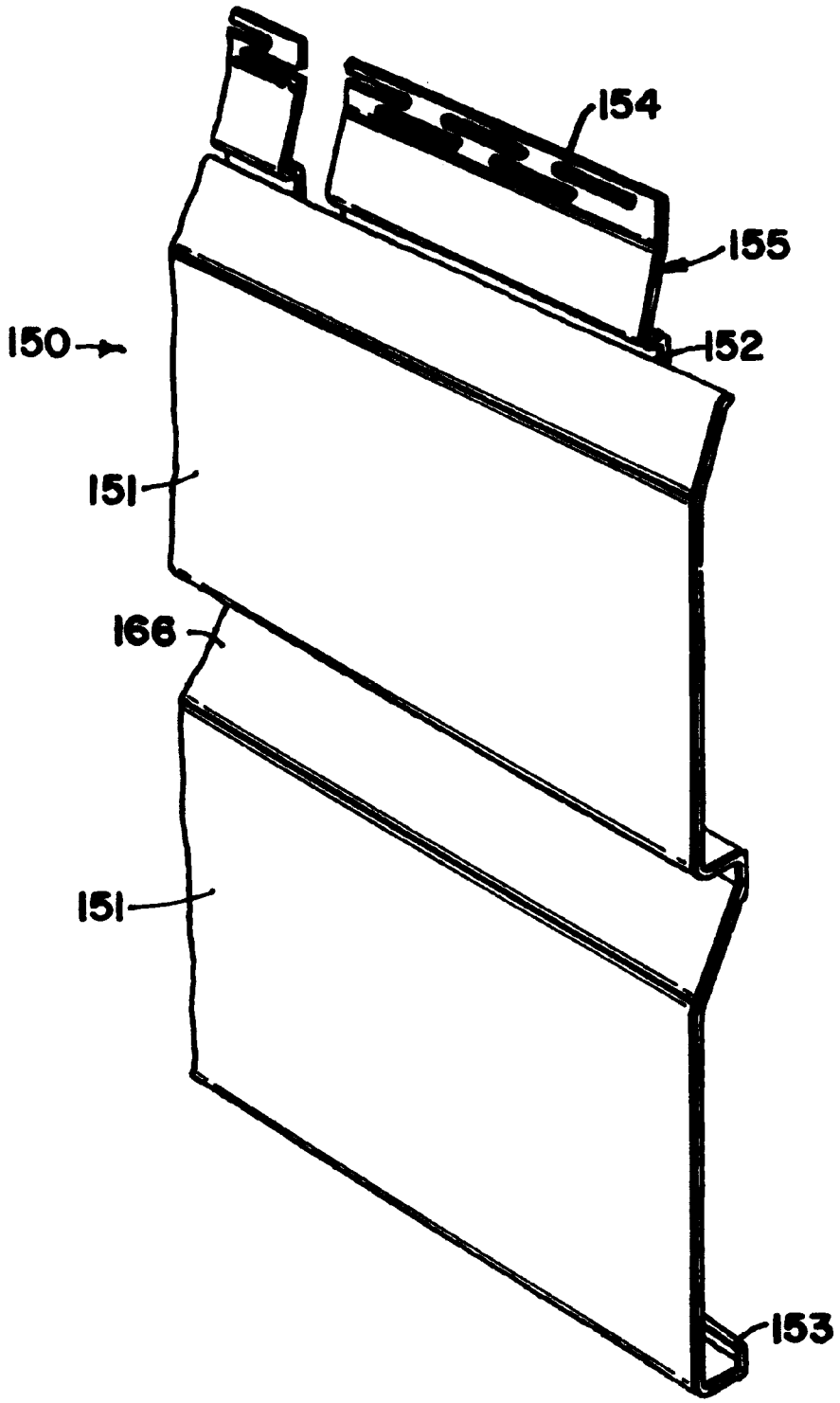
FIG. 14 is a perspective view of a tenth embodiment of the siding unit.

FIG. 14 is a perspective view of a tenth embodiment of the siding unit 150. With this embodiment, the siding may be installed either horizontally or vertically. The siding panel 150 is formed from the preferred composite material, but is solid and non-hollow rather than being hollow or webbed. The siding panel 150 has one or more planar front surfaces 151. An upper groove 152 in the panel 150 is adapted to accommodate and mate with a lower edge 153 of an adjacent panel 150. The siding 150 is fastened to the outer surface of the house by nails or other appropriate fastening means which are inserted into apertures 154 in the nailing flange 155. In order to provide installers with complete flexibility in the choice of positions in which to fasten the panels 150 to the house, the apertures 154 are preferable in the shape of elongated slots and may be arranged in two or more rows.

The panels 150 are profile extruded in the specific cross-sectional shape desired. A wide variety of cross sectional shapes and mating mechanisms can be devised by one skilled in the art. The panels 150 can be fabricated in pre-specified lengths for the particular job application desired, or can be formed in standard lengths and cut to size at the building site.

Each panel 150 may have multiple courses formed integrally with each other. With the panel 150 illustrated in FIG. 14, each siding panel has two courses or front surfaces 151. The two courses 151 are separated by a longitudinal groove 166 which extends inwardly from the front surfaces 151 of the panel 150 toward the house.

With each of the above siding designs, a thickness of ½ inch to 1½ inch is preferred, and a width in the range of 4 inches to 12 inches is preferred. It is possible for the siding member of each embodiment to be manufactured as an integral unit having two or more courses. Moreover, the present invention is suitable for various types of siding geometries and designs. For siding which is installed horizontally across a building, the siding of the present invention may have the following shapes which are well-known with respect to solid wood siding made of lumber: bevel and bungalow siding, Dolly Varden siding, drop siding, channel rustic (board and gap) lap siding, tongue-and-groove siding, and log cabin siding. These siding designs can be manufactured with the polymer-composite material of the present invention, and each of the above siding designs may have either a solid core or a hollow profile.

The Polymeric-Fiber Composite Material

The inventive siding units of the present invention are made of a composite material consisting of a polymeric material and a fiber material. Examples of such a material are described in Applicant's prior patents U.S. Pat. Nos. 5,486,553; 5,539,027; 5,406,768; 5,497,594; 5,441,801 and 5,403,677, each of which is incorporated herein by reference.

The siding units are formed from a composition of a substantially thermoplastic polymeric material and a fiber material, such as wood fiber. The primary requirements for the polymeric material is that it retains sufficient thermoplastic properties to permit melt blending with the fiber, that it permits formation of pellets, and that it permits the pellets to be extruded or injection molded in a thermoplastic process to form the rigid siding member. The preferred composite material of this invention can be made from any polyolefin, polystyrene, polyacrylic or polyester. Thermoplastic polymers that can be used in the invention comprise well known classes of thermoplastic polymers including polyolefins such as polyethylene, polypropylene, poly (ethylene-copropylene), polyethylene-co-alphaolefin and others. Polystyrene polymers can be used including polystyrene homopolymers, polystyrene copolymers and terpolymers; polyesters including polyethylene terephthalate, polybutylene terephthalate, etc. and halogenated polymers such as polyvinyl chloride, polyvinylidene chloride and others. Polymer blends or polymer alloys can also be useful in manufacturing the composite material used with the invention.

A variety of reinforcing fibers can be used with the siding of the present invention, including glass, boron, carbon, aramid, metal, cellulosic, polyester, nylon, etc. the composite can be used in the form of a solid unit comprising the composite of a solid unit of a foamed thermoplastic or as a hollow profile.

The preferred type of fiber for the invention is a soft wood fiber, which can be a product or product of the manufacture of lumber or other wood products. The soft wood fibers are relatively long, and they contain high percentages of lignin and lower percentages of hemicellulose, as compared to hard woods. However, the preferred cellulosic fiber could also be derived from other types of fibers, including flax, jute, cotton fibers, hard wood fibers, bamboo, rice, sugar cane, and recycled or reclaimed fiber from newspapers, boxes, computer printouts, etc. Preferably, the pellet uses a cellulosic fiber. The cellulosic fiber commonly comprises fibers having a high aspect ratio made of cells with cellulosic cell walls. During the compounding process, the cell walls are disrupted and polymers introduced into the interior void volume of the cells under conditions of high temperature and pressure.

The preferred source for wood fiber for the siding units is the wood fiber by-product of milling soft woods commonly known as sawdust or milling tailings. Such wood fiber has a regular reproducible shape and aspect ratio. The fibers are commonly at least 0.1 mm in length, up to 1 mm in thickness, and commonly have an aspect ratio of at least about 1.5. Preferably, the fibers are 0.1 to 5 mm in length, with an aspect ratio between 2 and 15, preferably between 2.5 to 10.

Some sawdust materials can contain substantial proportions of byproducts including polyvinyl chloride or other polymer materials that have been used as a coating, cladding or envelope on wooden members; recycled structural members made form thermoplastic materials; polymeric materials from coatings; adhesive components in the form of hot melt adhesives, solvent-based adhesives, powdered adhesives, etc.; paints including water-based paints, alkyd paints epoxy paints, etc.; preservatives, anti-fungal agents, anti-bacterial agents, insecticides, etc., and other byproduct streams. The total byproduct stream content of the wood fiber material is commonly less than 25 wt-% of the total wood fiber input into the thermoplastic-fiber composite product. Commonly, the intentional byproduct content ranges from about 1 to about 25 wt-%, preferably about 2 to about 20 wt-%, most commonly from about 3 to about 15 wt-%.

Control of moisture in the thermoplastic-fiber composite is important to obtaining consistent, high-quality surface finish and dimensional stability of the siding units. Removal of a substantial proportion of the water in the fiber is required in order to obtain an optimal pellet for processing into the siding units. Preferably, water is controlled to a level of less then 8 wt-% in the pellet, based on the pellet weight, if processing conditions provide that vented extrusion equipment can dry the material prior to the final formation of the siding member. If the siding members are to be extruded in a non-vented extrusion process, the pellet should be as dry as possible and have a water content between 0.01 and 5 wt-%, preferably less than 3.5 wt-%.

The maximum water content of the composite pellet is 4 wt-% or less, preferably 3.0 wt-% or less and most preferably the pellet material contains from about 0.5 to 2.5 wt-% water.

In the manufacture of the composition and pellets which are used for the siding material, two steps are involved: 1) the blending step, in which the polymeric material and fiber and intimately mixed, and 2) the pelletizing step, in which the composition is extruded and formed into pellets. The extruded composition is formed in a die to form a linear extrudate that can be cut into a pellet shape. The pellet cross-section can be any arbitrary shape depending on the extrusion die geometry. Preferably, a regular geometric cross-sectional shape is used, and most preferably the shape of the pellet is a regular cylinder having a roughly circular or somewhat oval cross-section. The pellet material is then introduced into an extruder and extruded into the siding units of the present invention.

The materials fed to the extruder preferably comprise from about 30 to 65 wt-% of sawdust including recycled impurity along with from about 50 to 70 wt-% of polymer compositions, such as polyvinyl chloride. Preferably, about 35 to 45 wt-% wood fiber or sawdust is combined with polyvinyl chloride homopolymer.

Suitable additives which may be included are chemical compatibilizers, thermal stabilizers, process aids, pigments, colorants, fire retardants, antioxidants, fillers, etc.

The most preferred system is polyvinyl chloride and wood fiber, wherein the density of the pellet is greater than about 0.6 gram per cubic cm. Preferably, the density of the pellet is greater than 0.7 gram per cubic cm for reasons of improved thermal properties, structural properties, modulus, compression strength, etc., and most preferably the bulk density of the pellet is greater than 0.8 gram per cubic cm. In the most preferred pellet compositions of the invention, the polyvinyl chloride occupies greater than 67% of the interior volume of the wood fiber cell and most preferably greater than 70% of the interior volume of the wood fiber cell. The pellet can have a variety of cross-sectional shapes including triangular, square, rectangular, oval, etc.

The preferred pellet is a right circular cylinder, the preferred radius of the cylinder is at least 1.5 mm with a length of at least 1 mm. Preferably, the pellet has a radius of 1 to 5 mm and a length of 1 to 10 mm. Most preferably, the cylinder has a radius of 2.3 to 2.6 mm, a length of 2.4 to 4.7 mm, and a bulk density of about 0.2 to about 0.8 gm/cubic mm.

After the pellets are formed, the siding panels 11 are preferably profile extruded in the specific cross-sectional shape desired. However, it is also possible for the panels to be molded, vacuum formed, bent or roll-formed from sheet material. The panels can be fabricated in pre-specified lengths for the particular job application desired, or can be formed in standard lengths and cut to size at the building site.

The coefficient of thermal expansion of the preferred polymer-fiber composite material is a reasonable compromise between the longitudinal coefficient of thermal expansion of PVC, which is typically about $4\times10^{-5}$ in./in./degree F, and the thermal expansion of wood in the transverse direction, which is approximately $0.2\times10^{-5}$ in./in./degree F. Depending upon the proportions of materials and the degree to which the materials are blended and uniform, the coefficient of thermal expansion of the material can range from about 1.5 to $3.0\times10^{-5}$ preferably about 1.6 to $1.8\times10^{-5}$ in./in./degree F.

The preferred composite material displays a Young's modulus of at least 500,000 psi, most preferably in the range between 800,000 and $2.0\times10^{6}$ psi.

Caps tock

In the preferred embodiment, the composite material has a coating means. For example, the composite material is coextruded with a weather resistant capstock 35 which is resistant to ultra-violet light degradation. One example of such a material is a polyvinylidene difluoride composition. The capstock features a desirable surface finish, has the desired hardness and scratch resistance, and has an ability to be colored by the use of readily available colorants. Preferably, the gauge thickness for the cap coat is approximately 0.001 to 0.100 inches across the siding surface, most preferably approximately 0.02 inch. The capstock 35 is coextensive with at least the exposed surfaces of the siding unit substrate and is tightly bonded thereto.

One suitable type of capstock is a Duracap® polymer, manufactured by The Geon Company, which is described in U.S. Pat. Nos. 4,183,777 and 4,100,325. In addition, an AES-type polymer can be used (such as Rovel® brand weatherable polymers manufactured by The Dow Chemical Company), or an ASA-type polymer can be used (such as Geloy® and Centrex® polymers manufactured by the General Electric Company and Monsanto, respectively). The capstock can be either coextruded with the substrate or laminated onto the substrate. In the preferred embodiment, the capstock is coextruded. The coextrusion of the capstock polymer is accomplished with dual-extrusion techniques, so that the capstock and substrate are formed as a single integral unit. Because the capstock may contain colorants and pigments, no additional topcoating is necessary or required in the resulting structures. However, a coating of paint or other material may be applied if desired.

Besides a capstock, the outer layer 11 could be a veneer, a wood grain covering, a pigmented covering, or another type of coextruded layer. In the preferred embodiment, the outer surface of the siding 11 is smooth. However, the-siding could feature decorative indentations on the outer surface, for example, to resemble the appearance of wood. The texture could be produced by use of an embossing wheel, through which the siding passes after the extrusion process.

Joinder of Siding Units End-to-End

The siding panels 11 are typically made of a fixed length shorter than the width of a side of most houses, and thus it is necessary to butt, splice or join two panels 11 together at their ends. In the preferred embodiment of horizontal siding, each siding unit has a nominal length of 16 feet, with an actual length of 16 feet, 4 inches. With respect to the vertical siding designs, the preferred length would be approximately 12 feet. Adjacent siding units are connected end-to-end with a butt joint, and there is no overlapping of the siding units with this type of connection. The ends of each siding unit may be mitered to have a beveled interconnection surface.

Figure 10:
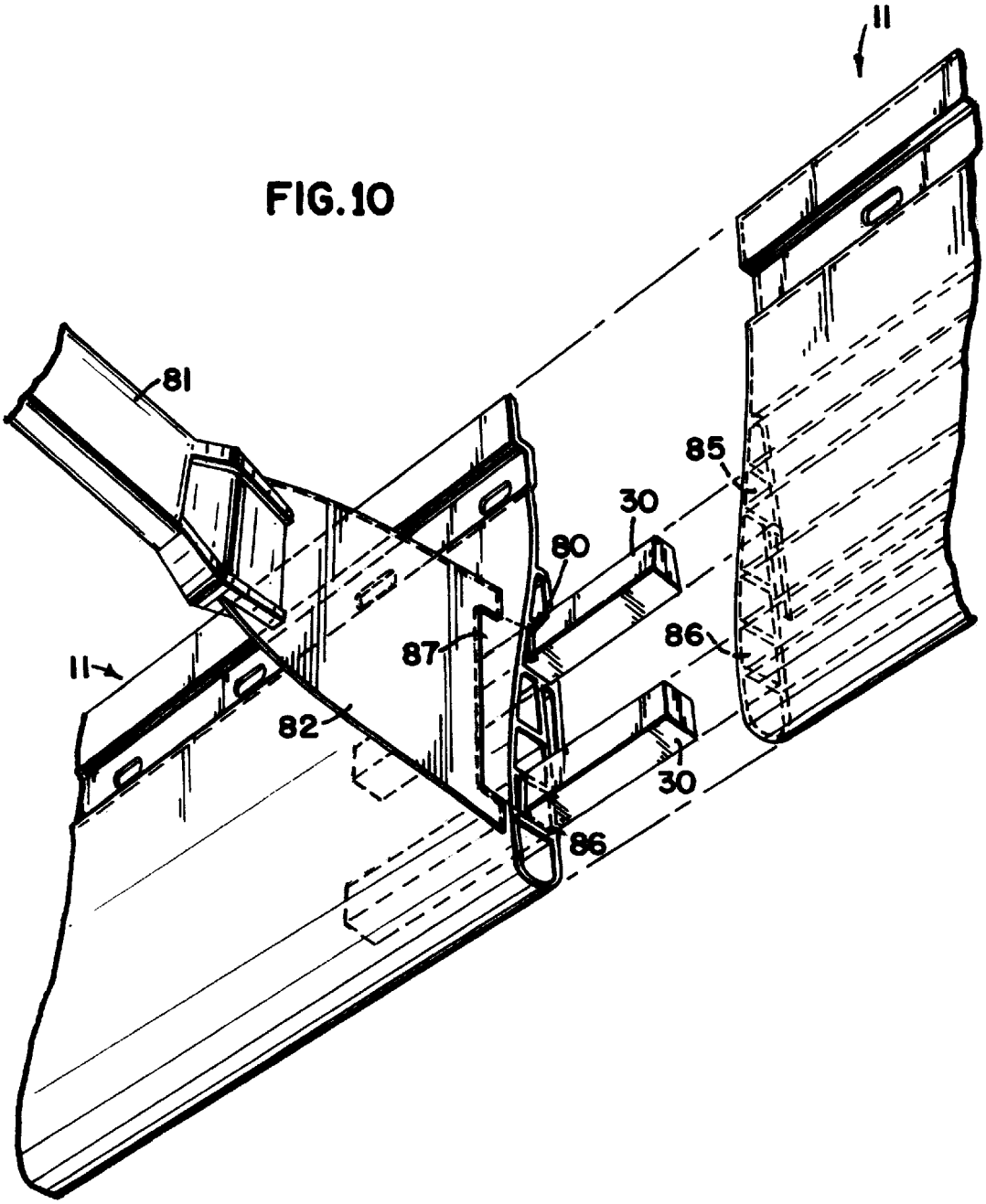
FIG. 10 is an exploded, perspective view of the siding units, inserts used with the siding units, as well as an optional installation tool.

As illustrated in FIG. 10, one or more inserts or keys 30 are placed into one or more hollow web apertures of each siding unit 11, so that the inserts 30 are hidden from view when the joint is complete. The inserts 30 can be formed from wood, aluminum, from a suitable thermoplastic or thermosetting material, e.g., by injection molding, or it may be made from the preferred composition material described above. The insert 30 can be shaped to provide a 180 degree extension (as illustrated), the inserts 30*a* (FIG. 1) may be designed to provide a 90 degree angle between two siding units, or to provide an interconnection at some other arbitrary acute or obtuse angle. The insert 30 projects from approximately 1 to 5 inches into the hollow interior portion of the siding unit 11. In the preferred embodiment, two inserts 30 are used for each butt joint, and the inserts are approximately three inches long, i.e., each insert extends approximately 1½ inches into each siding unit 11.

In the preferred embodiment, the two inserts are sized and configured to fit in the two web apertures 85, 86. The apertures 85, 86 are the apertures next to the two end web apertures. The inserts 30 connect the siding units 11 by adhesive means in the preferred embodiment, such as a hot melt urethane adhesive. One example of a suitable, curable cyano acrylate adhesive is Model 401 sold by Loctite Corporation of Hartford, Conn.

Each insert 30 is sized and configured to correspond with the appropriate hollow aperture 85, 86 in the siding unit 11. For many embodiments of the siding assembly, the hollow apertures are not symmetrical. However, in the preferred embodiment, the inserts 30 are designed such that they can be inserted at an orientation, i.e., either upside-down or right-side-up. Each insert 30 preferably has rounded corners and an indentation in at least one wall of the insert 30 in order to facilitate flow of the adhesive. In addition, each insert 30 has a transverse groove 80 at the insert's center line. An installation tool 81 has a blade 82, the thickness of which is sized and configured to correspond to the groove 80. The blade has a notch 87 which is the same width as the distance between the outer walls of the apertures 85, 86. Thus, the two inserts 30 slide within the notch 87 of the blade 82. In this manner, the tool 81 facilitates the proper positioning of the insert 30 with respect to the siding unit 11. The blade 82 is abutted against the end of the siding unit 11, and the insert 30 is slid into the siding unit 11 until the groove 80 is in engagement with the blade 82. This engagement prevents the insert 30 from entering the siding unit too far. The inserts 30 may be adhered to the siding unit 11 at the same time that the siding 11 is installed on the building, or the inserts may be attached to the siding units 11 during the manufacturing of the siding 11.

Adjacent siding units can also be connected by using a thermal welding technique. With such a welding technique, each end of adjacent siding units is heated to a temperature above the melting point of the composite material and while hot the mating surfaces can be contacted in the required configuration. The contacted heated surfaces fuse through an intimate mixing of molten thermoplastic from each surface. The two heated surfaces fuse together to form a welded joint. Once mixed, the materials cool to from a structural joint which has superior joint strength characteristics. Any excess thermoplastic melt that is forced from the joint area by pressure in assembling the surfaces can be removed using a heated surface, mechanical routing, or a precision knife cutter. In addition, thermal welding can be used in conjunction with an insert design, in which the insert is fused to the internal web 23 of the siding units ii.

In the alternative, the adjacent units may be joined with a variety of known mechanical fastener techniques, including screws, nails and other hardware. The siding units 11 can be cut or milled with conventional wood working equipment to form rabbet joints, tongue and groove joints, butt joints, notched corners, etc. The siding units 11 may be joined together with a solvent, structural or hot melt adhesive. Solvent-borne adhesives that can act to dissolve or soften thermoplastic material can also be used.

Experimental Section

The following examples and data were developed to further illustrate the invention that is explained in detail above. The information contains a best mode and illustrates the typical production conditions and composition for a pellet and siding unit of the present invention.

To make the pellets, a Cincinnati Millicon extruder with an HP barrel, Cincinnati pelletizer screws, and an AEG K-20 pelletizing head with 260 holes, each hole having a diameter of about 0.02 inches was used. The input to the pelletizer comprised approximately 60 wt-% polymer and 40 wt-% sawdust. The polymer material comprised a thermoplastic mixture of approximately 100 parts of vinyl chloride homopolymer, about 15 parts titanium dioxide, about 2 parts ethylene-bis-stearamide wax lubricant, about 1.5 parts calcium stearate, about 7.5 parts Rohm & Haas 980-T acrylic resin impact modifier/process aid and about 2 parts of dimethyl tin thioglycolate. The sawdust input comprised a wood fiber particle containing about 5 wt-% recycled polyvinyl chloride having a composition substantially identical to the polyvinyl chloride recited above. The initial melt temperature of the extruder was maintained between 375° C. and 425° C. The pelletizer was operated on a vinyl/sawdust combined ratio throughput of about 800 pounds/hour. In the initial extruder feed zone, the barrel temperature was maintained between 215°–225° C., and the compression zone was maintained at between 205°–215° C. In the melt zone, the temperature was maintained at 195°–205° C. The die was divided into three zones, the first zone at 185°–195° C., the second zone at 185°–195° C., and in the final die zone 195°–205° C. The pelletizing head was operated at a setting providing 100–300 rpm, resulting in a pellet with a diameter of about 0.1–0.2 inch and an length of about 0.08–0.3 inch.

The composite material was made from a polyvinyl chloride known as Geon 427 obtained from B.F. Goodrich Company. The polymer is a polyvinyl chloride homopolymer having a molecular weight of about 88,000±2,000 grams/mole. The wood fiber is sawdust byproduct of milling soft woods in the manufacture of wood windows a Andersen Corporation, Bayport, Minn. The wood fiber input contained 5% intentional PVC impurity recycle.

EXAMPLE I

Young's Modulus Test Results

The Young's modulus was measured using an Instron Model 450S Series 9 software automated materials testing system and an ASTM method D-638. Specimens were made according to the test and were measured at 50% relative humidity, 73° F. with a cross head speed of 0.200 in./min.

The preferred pellet of the invention displays a Young's modulus of at least 500,000 and commonly falls in the range greater than about 800,000, preferably between 800,000 and $2.0\times10^6$ psi.

The Young's modulus for the polyvinyl chloride compound, measured similarly to the composite material, is about 430,000 psi.

Lengths of the siding were manufactured and tested for coefficient of thermal expansion, thermal conductivity, decay, corrosion, heat distortion temperature, water absorption, moisture expansion, and compression load. For many of these characteristics, the composite siding of the present invention was compared to siding manufactured with conventional siding materials. The following Tables display the test data developed in these experiments and obtained from published sources. The material of the preferred siding unit is indicated by the designation "Polymer-Fiber Composite" in the Examples below. This "Polymer-Fiber" composite material is the material described above, made of 60 wt-% polyvinyl chloride and 40 wt-% fiber derived from a soft wood.

Using the methods for manufacturing a pellet and extruding the pellet, a siding member as illustrated in FIGS. 1–5 was manufactured using an appropriate extruder die. The melt temperature of the input to the machine was 390°–420° F. A vacuum was pulled on the melt mass of no less that 3 inches mercury. The overall width of the unit was about 6¼ inches. The wall thickness of any of the elements of the extrudate was about 0.1 inch.

Several-different siding materials were tested and/or analyzed, as shown on the tables below. The data for the five types of siding materials, other than the composite material, was obtained from published sources. For aluminum, the data was obtained from Metals Handbook, Vol. 2, 9th Ed., American Society for Metals, 1990. For PVC, the data was obtained from the specifications and product literature for PVC siding which is manufactured by Reynolds Metals Company of Richmond, Va. For cedar, the data was obtained from *Forest Products and Wood Science*, J. G. Haygreen and J. L. Bowyer, The Iowa State University Press, 1982. For Masonite™, the data was obtained from the specifications and product literature for Masonite siding obtained from Masonite Corporation of Chicago, Ill. (The Masonite material is a fiber board material made from hard wood fibers and cement binders.) The data for steel was obtained from *Metals Handbook*, Vol. 1, 9th Ed., American Society for Metals, 1990.

EXAMPLE II

Coefficient of Thermal Expansion Tests

The strain due to a 1° temperature change is known as the coefficient of thermal expansion. The deformation per unit length in any direction or dimension is called strain.

The coefficient of thermal expansion was measured for the composite siding and for the PVC siding using ASTM Test Method D696. The data for the other materials was obtained from the above published sources.

| Material | COTE (in. /in. /° F.) |
|---|---|
| Fiber-Polymer Composite | $11 \times 10^{-6}$ |
| Aluminum | $12.1 \times 10^{-6}$ |
| PVC | $36 \times 10^{-6}$ |
| Cedar | $3$ to $5 \times 10^{-6}$ |
| Masonite ® | $<3 \times 10^{-6}$ |
| Steel | $12 \times 10^{-6}$ |

The above table shows that the coefficient of thermal expansion for the composite siding is significantly less than the coefficient of thermal expansion for PVC siding. The composite's coefficient of thermal expansion was somewhat less than the aluminum and steel siding.

EXAMPLE III

Thermal Conductivity Tests

Thermal conductivity is the ratio of the steady-state heat flow (heat transfer per unit area per unit time) along a long rod to the temperature gradient along the rod. Thermal conductivity indicates the ability of a material to transfer heat from one surface to another surface.

The thermal conductivity of the composite siding and the PVC was tested using ASTM Test Method F433. The data for the other materials was obtained from the above published sources.

| Material | Thermal Conductivity (W/mK) |
|---|---|
| Fiber-Polymer Composite | 0.17 |
| Aluminum | 0.173 |
| PVC | 0.11 |
| Cedar | 0.09 |
| Masonite ™ | N/A |

-continued

| Material | Thermal Conductivity (W/mK) |
|---|---|
| Steel | 59.5 |

The above table shows that the thermal conductivity of the composite material was less than that of the PVC siding, about the same as aluminum, and significantly less than steel. (The thermal conductivity of Masonite was not tested.)

EXAMPLE IV

Heat Distortion Temperature Tests

The heat distortion temperature is the point at which the material begins to warp or become distended. The composite and PVC siding was tested pursuant to ASTM Test Method D648. There is no data given for the metals, because the other materials do not distort until an extremely high temperature is reached.

| Material | Temperature (° F.) |
|---|---|
| Fiber-Polymer Composite | 200 |
| Aluminum | N/A |
| PVC | 170 |
| Cedar | N/A |
| Masonite ® | N/A |
| Steel | N/A |

The above table shows that the heat distortion temperature for the composite material was higher than the heat distortion temperature for PVC. (The heat distortion temperature was not measured for those materials having an "N/A" value.)

EXAMPLE V

Moisture Expansion and Water Absorption Test Results

The materials were evaluated with respect to their propensity to expand when subjected to water. The composite and PVC siding was tested for moisture absorption pursuant to ASTM Test Method D570-84. The metal materials are designated "None", because the metals do not absorb water. Cedar is designated "Yes," because it does absorb water and does have a tendency to expand. PVC is designated "N/A," because PVC's water absorption is so low as to not be measurable.

| Material | Moisture Expansion | Water Absorption |
|---|---|---|
| Composite | No | 0.90% |
| Aluminum | No | None |
| PVC | No | N/A |
| Cedar | Yes | Yes |
| Masonite ® | Yes | 12% |
| Steel | No | None |

The above table shows that the composite material has a lower water absorption than cedar and Masonite.

EXAMPLE VI

Decay and Corrosion Test Results

The materials were evaluated with respect to their propensity to show decay and corrosion.

| Material | Decay Test Result | Corrosion Test Result |
|---|---|---|
| Composite | No | No |
| Aluminum | No | Yes |
| PVC | No | No |
| Cedar | No | No |
| Masonite ® | No | No |
| Steel | No | Yes |

EXAMPLE VII

Impact Testing

The determination of the resistance of impact of the main profiles by a falling mass was determined by the following procedure. This procedure is a modification of the CEN/TC33 "European Standard Method for the determination of the resistance to impact by a falling mass at about 21.1° C. (70° F.) of unplasticized polyvinyl chloride (PVC-U) main profiles used in the fabrication of windows and doors for the assessment of physical properties of the extrusion piece. Eighteen inch length test pieces (about 48.5 centimeters) were cut from lengths of main profiles and were subjected to a blow from a mass falling from a known height on the surface of the profile at a point midway between two supporting webs at a fixed width and at a fixed temperature. After testing, the profiles are visually examined for failures which appear at the point of impact. Main profile typically refers to an extruded piece having load bearing functions in a construction such as a window or door. The test surface, sight surface or face surface of the profile is a surface exposed to view when the window is closed. The falling weight impacts the face surface, sight surface or exposed surface. A web typically refers to a membrane which can be rigid or non-rigid connecting two walls of the main profile. The impact testing machine apparatus incorporates the following basic components. The main frame is rigidly fixed in a vertical position. Guide rails fixed to the main frame accommodate the falling mass and allow it to fall freely in the vertical plane directly impacting the face surface or the sight surface of the test profile. The test piece support consists of a rounded off support member with a distance between 200±1 millimeters. The support is made from steel and rigidly fixed in a solid foundation or on a table with a mass of more than 50 kilograms for stability. A release mechanism is installed such that the falling mass can fall through a height which can be adjusted between 1500±10 millimeters measured from a top surface of the test piece to the bottom surface of the falling mass. The falling mass is selected having 1000±5 grams. The falling mass has a hemispherical striking surface that contacts the face surface of the profile. The hemispherical striking surface has a radius of about 25±0.5 millimeters. The striking surface of the falling mass shall be smooth and conform to the hemispherical striking shape without the imperfections that could cause damage resulting from effects other than impact. One or more test pieces were made by sawing appropriate lengths from typical production profile extrusion pieces. The test pieces were conditioned at a temperature of about 21.1±0.2° C. for at least one hour prior to testing. Each test piece was tested within 10 seconds of removal from the conditioning chamber to ensure that the temperature of the piece did not change substantially. The profile was exposed to the impact from the falling mass onto the sight surface, face surface or exposed surface of the profile. Such a surface is the surface designed to be exposed to the weather. The falling mass is dropped directly onto the sight surface at a point midway between the supporting webs. The profile is to be adjusted with respect to the falling mass such that the falling mass strikes in a direction normal to the surface of the test face. The results of the testing are shown by tabulating the number of test pieces tested, the number of pieces broken or if not broken, the depth of any defect produced in the profile by the test mass.

| Material | Depth of Dent (inches) |
|---|---|
| Fiber-Polymer Composite | −0.0070 |
| Aluminum | N/A |
| PVC | −0.0650 |
| Cedar | −0.0630 |
| Masonite ® | −0.0025 |
| Steel | −0.0315 |

The above table shows that the composite materials resistance to denting is better than each of the five materials tested, except for Masonite. The composite materials dent resistance is significantly better than aluminum and PVC. (No reading could be obtained from the aluminum specimen, because of breakage of the aluminum profile.)

Even though numerous characteristics and advantages of the invention have been set forth in the foregoing description, together with the details of the structure and function of the invention, the disclosure is illustrative only, and changes may be made in detail, especially in matters of shape, size and arrangement of parts, within the principles of the invention, to the full extent indicated by the broad, general meaning of the appended claims.

We claim:

1. A siding assembly for an exterior wall surface of a building made up of a plurality of siding units, said units adapted to be affixed to a building with similar units in overlapping horizontal courses with the units of each course lying in overlapping relation, said building having a support structure, each of said units comprising:

a profile made of a composite material including a thermoplastic polymer and a cellulosic fiber, said material comprising about 35–60 parts of fiber and about 45–70 parts of polymer per each 100 parts of said composite material;

said unit comprising a main body portion including a front face and a rear face, said front face being exposed on assembly of said siding unit on a building, said front face being convex; an upper portion extending from said main body portion, said upper portion having a plurality of slots, said upper portion including a tongue means; and a groove means sized and configured to mate with said tongue means, wherein said groove means is located behind said main body portion.

2. The siding assembly of claim 1, wherein said main body portion includes a plurality of webs, said webs dividing a plurality of hollow portions.

3. The siding assembly of claim 1, wherein each of said siding units has an outwardly facing coating means.

4. The siding assembly of claim 3, wherein said coating means comprises a coextruded layer.

5. The siding assembly of claim 4, wherein said coextruded layer comprises a capstock.

6. The siding assembly of claim 5, wherein said capstock is coextruded with said front face so as to cover a portion of said front face.

7. The siding assembly of claim 6, wherein said capstock comprises a wood grain appearance.

8. The siding assembly of claim 6, wherein said capstock comprises a polyvinylidene difluoride composition.

9. The siding assembly of claim 1, wherein a portion of said main body portion is exposed and the size of said exposed portion is adjustable.

10. The siding assembly of claim 1, wherein a plurality of siding units are connected by thermal welding means.

11. The siding assembly of claim 1, wherein at least a portion of said siding unit includes a foamed composite material.

12. The siding assembly of claim 2, further comprising an insert which is sized and configured to fit within said hollow portions for attachment of adjacent siding units.

13. The siding assembly of claim 1, wherein the siding is combined with a trim piece, the trim piece also being made of said composite material.

14. The siding assembly of claim 12, wherein said insert joins two of said units at an outside corner.

15. The siding assembly of claim 2, wherein at least one of said hollow portions includes a foamed insulating material.

16. The siding assembly of claim 1, further comprising a fastener strip integral with said tongue means, wherein said plurality of slots are formed in said fastener strip.

17. The siding assembly of claim 16, wherein said tongue means comprises a mating flange which extends above said fastener strip.

18. The siding assembly of claim 15, wherein said siding unit includes a back wall for contacting said support structure, said back wall including a flange which overlaps at least a portion of said rear face of said main body portion so as to form an overlapping portion, said overlapping portion comprising said groove means.

19. The siding assembly of claim 1, wherein said polymer is polyvinyl chloride and said fiber is a wood fiber.

20. The siding assembly of claim 1, wherein said composite material is manufactured from a pellet.

21. The siding assembly of claim 20, wherein said pellet consists essentially of a thermoplastic cylindrical extrudate having a width of about 1 to 5 mm and a length of about 1 to 10 mm; said pellet consisting essentially of:

(a) a continuous phase comprising a polymer comprising vinyl chloride;

(b) an effective amount of wood fiber having a minimum thickness of 0.1 mm and a minimum aspect ratio of about 1.8; and (c) less than about 8 wt-% water; and wherein said polymer and said wood fiber are mixed at elevated temperature and pressure such that an intimate admixture is formed such that said wood fiber is dispersed throughout a continuous thermoplastic polymer phase, said pellet being a recyclable thermoplastic.

22. The siding assembly of claim 21, wherein said composite material has a Young's modulus of at least about 600,000 psi.

23. The siding assembly of claim 19, wherein said polymer comprises a polyvinyl chloride homopolymer.

24. The siding assembly of claim 19, wherein the polymer comprises a polyvinyl chloride polymer alloy.

25. The siding assembly of claim 19, wherein the wood fiber comprises a byproduct of milling or sawing wooden members.

26. The siding assembly of claim 25, wherein the wood fiber comprises sawdust.

27. The siding assembly of claim 21, wherein said composite material additionally comprises a compatibilizing agent.

28. The siding assembly of claim 1, wherein said fiber has a fiber width of about 0.3 to 1.5 mm, a fiber length of about 0.2 to 1.2 mm, and an aspect ratio in the range of about 1.5 to 7.

29. The siding assembly of claim 20, wherein water comprises about 0.01 to 5 wt-% of said pellet.

30. A siding assembly for an exterior wall surface of a building made up of at least a first siding unit and a second siding unit, each of said siding units having a front face, said units adapted to be affixed to a building with similar units, said building having a support structure, each of said units comprising:

a profile made of a composite material including a thermoplastic polymer and a fiber, said material comprising about 35–60 parts of fiber and about 45–70 parts of polymer per each 100 parts of said composite material;

said unit comprising a main body portion including said front face and a rear face; an upper portion extending from said main body portion, said upper portion including flange means; a lower portion sized and configured to mate with said flange means of a second siding unit, wherein a coating means is affixed at least to said front face of said siding units.

31. The siding assembly of claim 30, wherein said units are in an overlapping, horizontal relationship.

32. The siding assembly of claim 30, wherein said units are in a vertical relationship.

33. The siding assembly of claim 30, wherein said main body portion has a webbed structure.

34. The siding assembly of claim 30, wherein said main body portion is a planar member.

35. The siding assembly of claim 30, wherein said coating means comprises a capstock.

36. The siding assembly of claim 30, wherein a plurality of siding units are connected by thermal welding means.

37. The siding assembly of claim 30, wherein a plurality of siding units are connected by adhesive means.

38. The siding assembly of claim 33, wherein said siding unit includes a hollow portion, further comprising an insert which is sized and configured to fit within said hollow portion.

39. The siding assembly of claim 38, wherein said insert fits within said hollow portion at any orientation of said insert.

40. The siding assembly of claim 38, wherein said insert joins two of said units at a butt joint.

41. The siding assembly of claim 38, wherein said insert joins two of said units at an outside corner.

42. The siding assembly of claim 38, wherein at least one of said hollow portions includes a foamed insulating material.

43. The siding assembly of claim 29, wherein said polymer is polyvinyl chloride and said fiber is a wood fiber.

44. The siding assembly of claim 29, wherein said composite material is a pellet.

45. The siding assembly of claim 44, wherein said pellet consists essentially of a thermoplastic cylindrical extrudate having a width of about 1 to 5 mm and a length of about 1 to 10 mm; said pellet consisting essentially of,:

(a) a continuous phase comprising a polymer comprising vinyl chloride;

(b) an effective amount of wood fiber having a minimum thickness of 0.1 mm and a minimum aspect ratio of about 1.8; and (c) less than about 8 wt-% water; and wherein said polymer and said wood fiber are mixed at elevated temperature and pressure such that an intimate admixture is formed such that said wood fiber is dispersed throughout a continuous thermoplastic polymer phase, said pellet being a recyclable thermoplastic.

46. The siding assembly of claim 45, wherein said composite material has a Young's modulus of at least about 600,000 psi.

47. The siding assembly of claim 43, wherein said polymer comprises a polyvinyl chloride homopolymer.

48. The siding assembly of claim 43, wherein the polymer comprises a polyvinyl chloride polymer alloy.

49. The siding assembly of claim 43, wherein the wood fiber comprises a byproduct of milling or sawing wooden members.

50. The siding assembly of claim wherein the wood fiber comprises a byproduct of milling or sawing wooden members.

51. The siding assembly of claim 45, wherein the wood fiber comprises sawdust.

52. A method of manufacturing a siding member, comprising the steps of:

a) compounding a composite material including a fibrous material and a thermoplastic material;

b) providing a die having a desired shape of said siding member;

c) coextruding said composite material with a coating means so as to form a siding profile;

d) cutting said siding profile to a desired length.

53. The method according to claim 52, further comprising the step of affixing an insert means to said profile.

54. The method according to claim 53, wherein said fibrous material is a cellulosic fiber.

55. The method according to claim 54, wherein said fiber comprises sawdust.

56. The method according to claim 52, wherein said thermoplastic material comprises polyvinyl chloride.

57. The method according to claim 52, wherein said siding profile includes a webbed structure.

* * * * *

UNITED STATES PATENT AND TRADEMARK OFFICE

CERTIFICATE OF CORRECTION

PATENT NO. : 6,122,877
DATED : September 26, 2000
INVENTOR(S) : Hendrickson et al.

It is certified that error appears in the above-identified patent and that said Letters Patent is hereby corrected as shown below:

Column 24,
Line 28, "claim wherein" should read -- claim 45, wherein --

Signed and Sealed this

Thirtieth Day of April, 2002

*Attest:*

*Attesting Officer*

JAMES E. ROGAN
*Director of the United States Patent and Trademark Office*